US009724820B2

(12) United States Patent
Parzy et al.

(10) Patent No.: US 9,724,820 B2
(45) Date of Patent: Aug. 8, 2017

(54) ASSEMBLY OF STACKABLE TRUNKS

(75) Inventors: Sébastien Parzy, Lyons (FR); Dominique Parzy, Saint-Cyr-sur-le-Rhône (FR); Emilien Henry, Lyons (FR)

(73) Assignee: K-PLAN, Saint-Cyr-sur-le-Rhone (FR)

( * ) Notice: Subject to any disclaimer, the term of this patent is extended or adjusted under 35 U.S.C. 154(b) by 741 days.

(21) Appl. No.: 13/377,042

(22) PCT Filed: Jun. 8, 2010

(86) PCT No.: PCT/FR2010/051128

§ 371 (c)(1),
(2), (4) Date: Mar. 2, 2012

(87) PCT Pub. No.: WO2010/142903

PCT Pub. Date: Dec. 16, 2010

(65) Prior Publication Data

US 2012/0152800 A1 Jun. 21, 2012

(30) Foreign Application Priority Data

Jun. 8, 2009 (FR) ..... 09 02766

(51) Int. Cl.
*A45C 15/00* (2006.01)
*B25H 3/02* (2006.01)

(52) U.S. Cl.
CPC ..... *B25H 3/02* (2013.01)

(58) Field of Classification Search
USPC ..... 206/503, 504, 505, 501; 220/23.83, 220/23.86, 23.87, 23.88, 23.2, 23.4, 23.6
See application file for complete search history.

(56) References Cited

U.S. PATENT DOCUMENTS

| | | | | | |
|---|---|---|---|---|---|
| 2,858,957 | A | * | 11/1958 | Darrah | 220/23.4 |
| 3,346,137 | A | * | 10/1967 | Ricci | 220/23.6 |
| 3,568,879 | A | * | 3/1971 | Box | 206/504 |
| 4,258,847 | A | * | 3/1981 | Nierman | 206/504 |
| 4,592,601 | A | * | 6/1986 | Hlinsky et al. | 312/111 |
| 4,685,565 | A | * | 8/1987 | Sparling | 206/427 |
| 4,863,222 | A | * | 9/1989 | Posso | 312/107 |
| 7,311,202 | B2 | * | 12/2007 | Chen | 206/504 |
| 2006/0071581 | A1 | | 4/2006 | Harvey | |
| 2008/0060964 | A1 | | 3/2008 | Beckley | |

FOREIGN PATENT DOCUMENTS

| | | | |
|---|---|---|---|
| DE | 1280730 | B | 10/1968 |
| DE | 3532370 | A1 | 2/1987 |

* cited by examiner

*Primary Examiner* — Jacob K Ackun

(57) ABSTRACT

The invention relates to an assembly of at least two stackable transport trunks, each trunk having a body with a generally parallelepiped shape, including a bottom and four sidewalls connected to the bottom and being closed by a removable lid, one of the sidewalls of each trunk including nesting means for engaging with the nesting means of the sidewall of another trunk on which it is stacked. According to the invention, the nesting means are adapted for defining, when in engagement, a sliding link having a translation direction parallel to the side surfaces having the nesting means and to the bottoms of the trunks, and for guiding the translation of the trunks on each other, the corresponding sidewalls being adapted for enabling the cooperation of the nesting means and enabling said translation.

18 Claims, 5 Drawing Sheets

ASSEMBLY OF STACKABLE TRUNKS

This application is a U.S. National Phase Entry of International Application No. PCT/FR2010/051128, filed on Jun. 8, 2010, and claims the benefit of French Patent Application No. 09 02766, filed Jun. 8, 2009, both of which are hereby incorporated by reference for all purposes as fully set forth herein in their entireties.

The present invention relates to the technical field of technical and/or scientific equipment trunks or boxes providing a protective function during transport and a support function for the equipment at the point of use.

In the above field, transport trunks are known which generally comprise a body in plastic or composite material equipped with a removable lid. In order to enable the various trunks to be assembled to form a support rack for all the equipment fitted in the body of the trunks, they comprise assembly systems using male studs engaging with complementary female configurations to define connections formed by a socket joint in a direction normal to the studs and the complementary female configurations and most frequently on the faces bearing said configurations.

Such trunks generally give satisfaction in terms of their function of transport and protection of electrical or electronic equipment, but have the disadvantage of not always being easily assembled. In addition, the studs and complementary female configurations have the disadvantage of generating relatively high manufacturing costs while presenting some difficulty with assembly in a situation of the use of a large number of trunks stacked on top of one another or of trunks having a relatively high unit weight.

The need has therefore arisen for a new type of trunk or set of trunks which offers greater ease of assembly, particularly in a situation of the use of relatively bulky and heavy trunks.

In order to achieve that objective, the invention relates to an assembly of at least two stackable transport trunks, each trunk having a body with a generally parallelepiped shape, comprising a bottom and four sidewalls connected to the bottom and being closed by a removable lid, one of the sidewalls of each trunk comprising nesting means for engaging with the nesting means of a sidewall of another trunk on which it is stacked.

According to the invention, the nesting means are adapted for defining, when in engagement, a sliding link having a translation direction parallel to the side surfaces having the nesting means and to the bottoms of the trunks, and for guiding the translation of the trunks on each other, the corresponding sidewalls being adapted for enabling the cooperation of the nesting means and enabling said translation.

The use of said nesting means defining sliding links facilitates the positioning of the trunks on top of one another, particularly when the trunk assembly is formed by more than three trunks. In fact, the sliding link defined by nesting means enables a top trunk to be placed on a bottom trunk without the top trunk being perfectly aligned on the one which supports it, so that the vertical sidewalls of the trunk are fully clear, which facilitates handling of the top trunk. It is then possible to place said top trunk side by side with its neighbour simply by sliding the top trunk onto the bottom trunk by means of the sliding link defined by the nesting means according to the invention. Said sliding link then prevents the risk of the top trunk falling by guiding its movement perfectly.

According to the invention, the sliding link may be defined by complementary male and female configurations.

However, said embodiment is not strictly necessary to the invention, and according to one form of the invention the nesting means comprise, at the level of each corresponding side face of each trunk, at least two interlocking ribs in a projecting arrangement.

The use of said ribs as nesting means has the advantage firstly of providing full protection of the side faces fitted with the ribs and secondly of contributing to their rigidity. Furthermore, the use for the nesting means of elements projecting from the surfaces which hold them prevents any risk of fouling of the nesting means such as is liable to occur in the case of a hollow or female configuration.

According to the invention, only one of the sidewalls of each trunk in the assembly may contain nesting means. However, according to an embodiment aimed at allowing various assembly combinations of the different trunks forming the set, each trunk contains, at the level of its four sidewalls, nesting means comprising at least two mutually parallel interlocking ribs, and the internal edges alongside said ribs are then separated by a space called internal gap, whilst the external edges facing towards the outside opposite the internal edges are separated by a space called external gap. According to said embodiment, for each pair of opposite sidewalls, the external gap in the interlocking ribs of one wall is less than or equal to the internal gap in the interlocking ribs of the other sidewall.

According to one variant of said embodiment, in order to define a preferred assembly orientation, each trunk comprises two consecutive sidewalls having internal and external gaps which are approximately equal.

Within the scope of said variant, it is then possible for two other consecutive sidewalls to have different external gaps.

According to the invention, different forms may be envisaged for the interlocking ribs and they may for example have a generally trapezoidal form or a generally rectangular form.

According to the invention, an assembly of trunks may comprise trunks which are liable to have different applications or to display different functionalities.

Therefore the assembly may comprise at least one drawer trunk in which the body contains at least one internal partition which is perpendicular to two opposite sidewalls and to the bottom and defines at least one drawer receiving compartment, each partition having on its free edge opposite the bottom at least one U-shaped recess which is over 10 cm deep and over 20 cm wide and is below the length of the internal partition measured parallel to the bottom, each drawer comprising a back and a front opposite the back which is set back from or at the level of a longitudinal edge of the recess when the back of the drawer is in contact with the bottom of the drawer trunk. Said recesses then allow a seated user the option of putting his legs partly inside the drawer trunk when the latter supports a trunk containing equipment which can be used in a sitting position.

Within the scope of said embodiment and according to a further variant, each drawer contains means by which to lock it in a retracted position, the back of the drawer being in contact with the bottom of the trunk.

The assembly according to the invention may also comprise a gas bottle trunk, the body of which contains at least two partitions parallel to one another and to the bottom, each of which is provided with a window, the windows of both partitions being aligned on a central axis $\Delta$ inclined in relation to the bottom of the trunk to define a housing to take at least one cylindrical bottle of gas under pressure when in position.

According to a characteristic of the invention, each window may be elliptical in shape and be equipped on its circumference with at least three rollers designed to guide the bottle into its position. The arrangement of said window form combined with rollers ensures optimum fitting of each bottle inside the trunk. Further, the rollers provide perfect guidance of the bottle when it is inserted and removed.

In order to increase the fitting efficiency of each bottle, the lid of the gas bottle trunk may also comprise one or more elastically deformable cushioning elements arranged approximately in the alignment of the axis Δ or of the windows and designed to form a support for the top of the gas bottle when the lid is in position on the body of the gas bottle trunk.

For the same purpose, the gas bottle trunk may comprise on its bottom at least one elastically deformable cushioning element arranged approximately in the alignment of the axis Δ and designed to form a support for the bottom of the gas bottle.

According to a characteristic intended to further increase the ergonomics of the transportable system implementing the assembly according to the invention, a trunk may comprise a shelf hinged onto a sidewall of the trunk body so as to be movable in rotation between a folded position in which it is parallel to the bottom of the trunk and an unfolded position in which it is parallel to the sidewall carrying it.

Again for the purpose of increasing the ergonomics of the assembly according to the invention, at least one trunk in the assembly may comprise a lid equipped on a bottom face with fold-down feet designed to support the lid when they are in the opened-out position. Each fold-down foot may then have an adjustable end.

The use of said lid with integral feet also enables the ergonomics of the assembly according to the invention to be increased. When the lid is placed on the floor with the feet in the opened-out position, it can act as a base or support for the body forming the trunk. For this purpose the lid may contain nesting means on a top face designed to engage with the nesting means on a side face of the corresponding body.

For the same purpose, the lid may also be used as a table. For this, the lid may comprise on its bottom face means of holding a removable shelf designed to be placed on the top face of the lid, the shelf containing means of immobilization on its bottom face which are intended to engage with nesting means on the top face of the lid so as to block at least the translation of the shelf parallel to the top face of the lid and perpendicular to the ribs. The use of said removable shelf provides a work surface with a perfectly flat and clean surface. Further, the nesting means arranged on the bottom face of the shelf guarantee the correct immobilization thereof on the lid which supports it.

According to the invention, at least one of the trunks in the assembly may contain electrical and/or electronic equipment and means of connection to an electromagnetic energy source.

Within the scope of said embodiment, the invention may comprise:

- a power supply trunk which contains an electricity control and subtransmission unit and electricity distribution means connected to the subtransmission unit and;
- a trunk containing electrical and/or electronic equipment and means of connection to the distribution means of the power supply trunk.

The electricity connection and distribution means may then be formed in any appropriate way, such as for example in the form of multipoint electrical connectors.

The connection and distribution means may also be formed so as to provide contactless electricity transmission. For this purpose the connection means and the distribution means may be adapted to provide electricity transmission by contactless magnetic coupling, which avoids tedious plug-in operations. The means of power transmission by magnetic coupling may also be combined with means of contactless communication between the different trunks, either by radio waves or by the use of magnetic coupling communication means. Naturally, an assembly of trunks according to the invention may comprise several trunks of the same type or one trunk of each of the aforementioned types or trunks of only one type.

It should also be noted that the different forms, variants and characteristics of the invention may be combined with one another in various combinations provided that that they are not incompatible or mutually exclusive.

Various other characteristics and advantages of the invention are also based on the foregoing description given by reference to the attached drawings which illustrate non-limiting examples of embodiments of trunks forming an assembly according to the invention.

Figure 1:
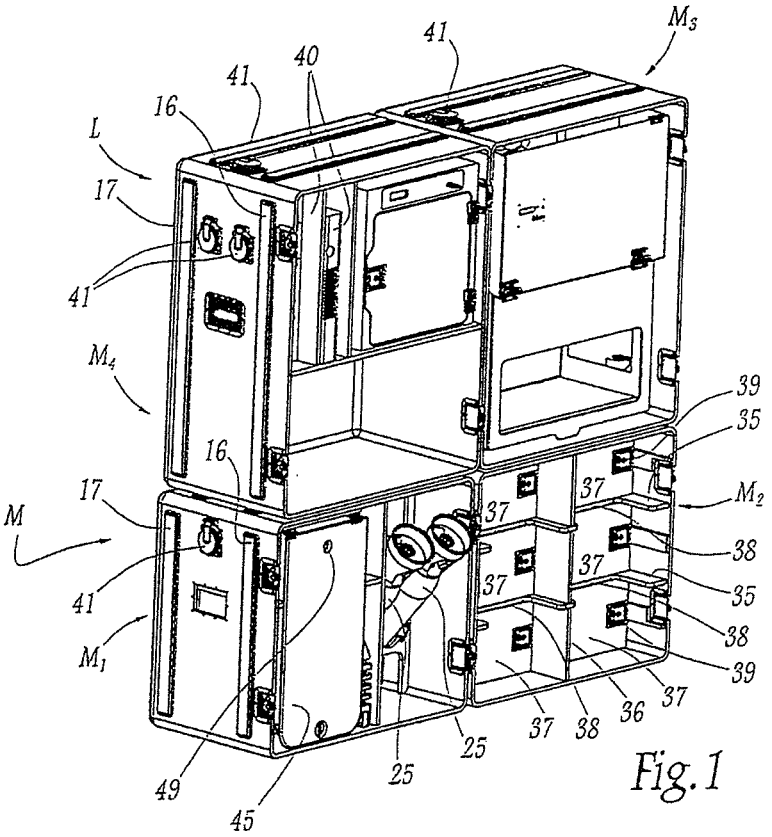
FIG. 1 is a schematic perspective view of an assembly of four trunks according to the invention, assembled and opened to form a mobile laboratory.

A set of stackable transport trunks according to the invention may, for example, be used after assembly to form a transportable laboratory as shown in FIG. 1.

Said laboratory designated as a whole by the reference L is formed in the example shown by four trunks M stacked and placed side by side.

Figure 2:
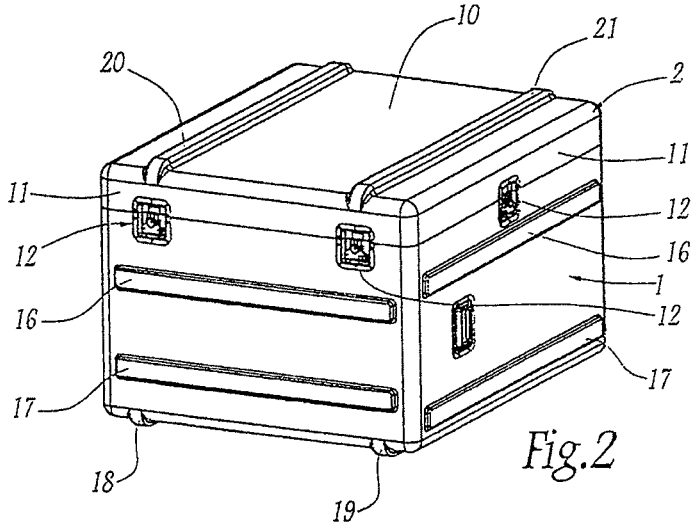
FIG. 2 is a schematic perspective view of a closed trunk according to the invention.
Figure 3:
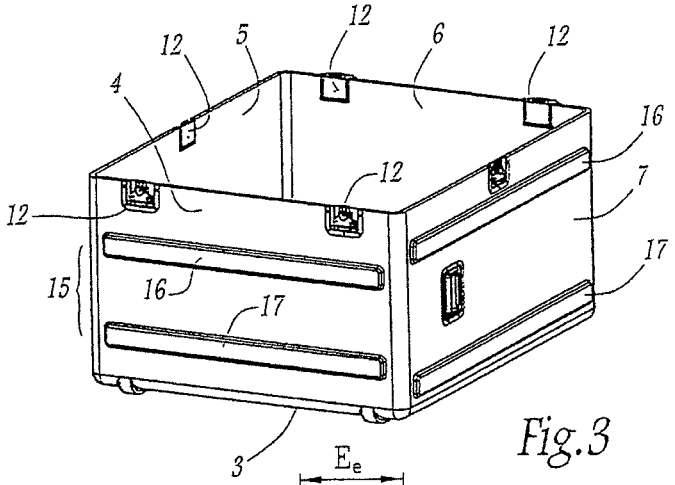
FIG. 3 is a schematic perspective view of the body, without the lid, of the trunk shown in FIG. 2.
Figure 4:
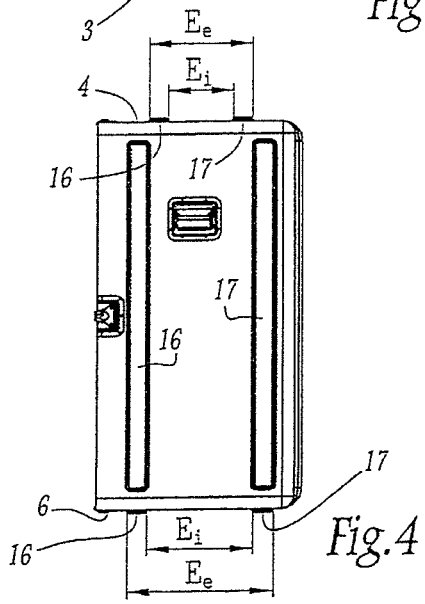
FIG. 4 is a side view of the trunk body shown in FIG. 3, in the vertical position.

As shown in particular in FIGS. 2 to 4, each trunk M making up the assembly L comprises a body 1 closed by a removable lid 2. The body 1 has a generally parallelepiped form comprising a bottom 3 bordered by four sidewalls 4 and 7 integral with the bottom 3. The walls 4 to 7 then define a face opposite the bottom 3 which is at least partly open and in the example shown is fully open and which provides access to the interior of the body of the trunk and the equipment which it may contain. The lid 2 also has a generally parallelepiped form with a top 10 bordered by four side flanges 11, only two of which are visible in FIG. 2. The flanges 11 are designed to be in alignment with the sidewalls 4 to 7 when the lid 2 closes the body 1. The trunk M contains means 12 of fixing the lid to the same, for example by toggle joint systems 12.

According to the example illustrated, the four sidewalls 4, 5, 6 and 7 each contain nesting means 15 formed by two ribs 16, 17 which extend parallel to the bottom 3 over a large part of the corresponding side length 4. The ribs 16 and 17 on each sidewall are mutually parallel and have a generally rectangular form with rounded angles when viewed in side elevation, as shown in FIG. 4, or in straight transverse section.

The longitudinal ribs 16 and 17 on each side face have opposite inside edges which are separated by a space called internal gap Ei measured perpendicular to said inside edges, whilst the outside edges of ribs 16 and 17 facing towards the outside opposite the inside edges are separated by a space called external gap Ee measured perpendicular to said outside edges.

Figure 5:
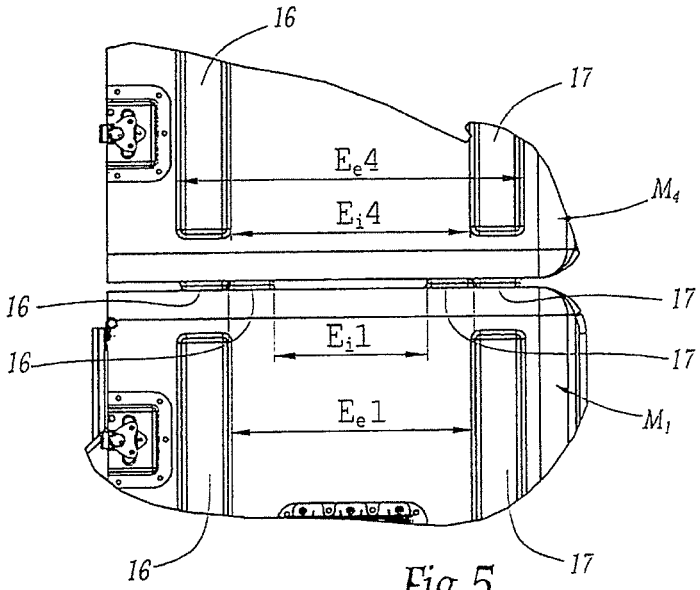
FIG. 5 is a partial side view showing the interlocking of the ribs of two trunks on top of one another.

To enable the trunks to engage in a position which could be called vertical, with a bottom sidewall of a top trunk M4 being supported on a top sidewall of a bottom trunk m1 as shown in FIG. 5, the internal gap Ei and external gap Ee of the longitudinal ribs of the bottom sidewall of a top trunk M4 do not have the same dimensions as the internal gap Ei and external gap Ee of the longitudinal ribs of the top sidewall of the bottom trunk m1.

In the example shown in FIG. 4, the external gap Ee1 of the bottom trunk is less than or equal to the internal gap Ei4 of the ribs 16 and 17 of the wall opposite the top trunk M4. For purposes of engagement with as little play as possible, according to the example shown, the gap Ei, the external gap Ee of the top wall 4 is approximately equal apart from the play to the internal gap Ei of the bottom wall 6. Also, according to this example, the internal and external gaps Ei and Ee of the walls forming 6 and 7 are approximately equal, whilst the internal and external gaps of the walls forming 4 and 5 are also approximately equal. By this configuration an orientation for stacking of the trunks forming the assembly L can be defined.

According to the example illustrated, the bottom 3 of the body 1 and the top 10 of the lid 2 also have interlocking ribs 18, 19, 20 and 21 respectively, the external gap of the ribs of the lid 2, 20 and 21 being approximately equal apart from the interlocking play to the internal gap of the ribs 18 and 19 of the bottom 3 of the body 1. Therefore the interlocking ribs 18 to 21 enable the trunks according to the invention to be stacked in stable fashion on top of one another when they are closed. The ribs 18 to 21 also contribute to the rigidity of the top 10 of the lid 2 and bottom 3 of the body 1.

The assembly L according to the invention comprises four trunks formed by these means and designed to be stacked on top of one another, as shown in FIG. 1, whereby their open fronts are all oriented vertically on the same side. In this example, each of the trunks has different characteristics and functionalities.

Figure 6:
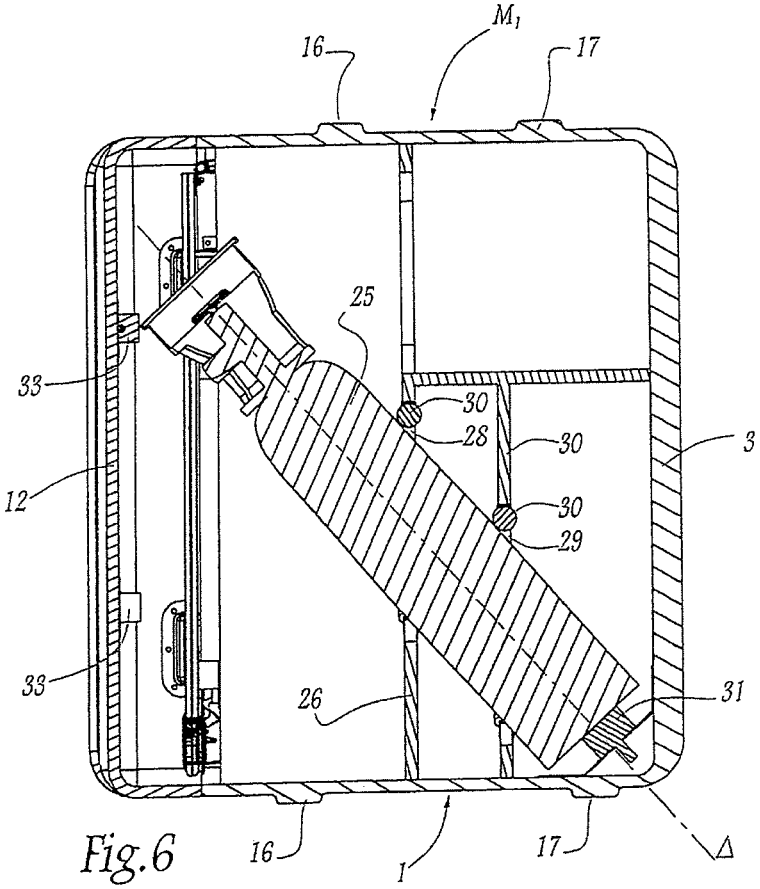
FIG. 6 is a schematic transverse section of a gas bottle trunk belonging to the assembly according to the invention.
Figure 7:
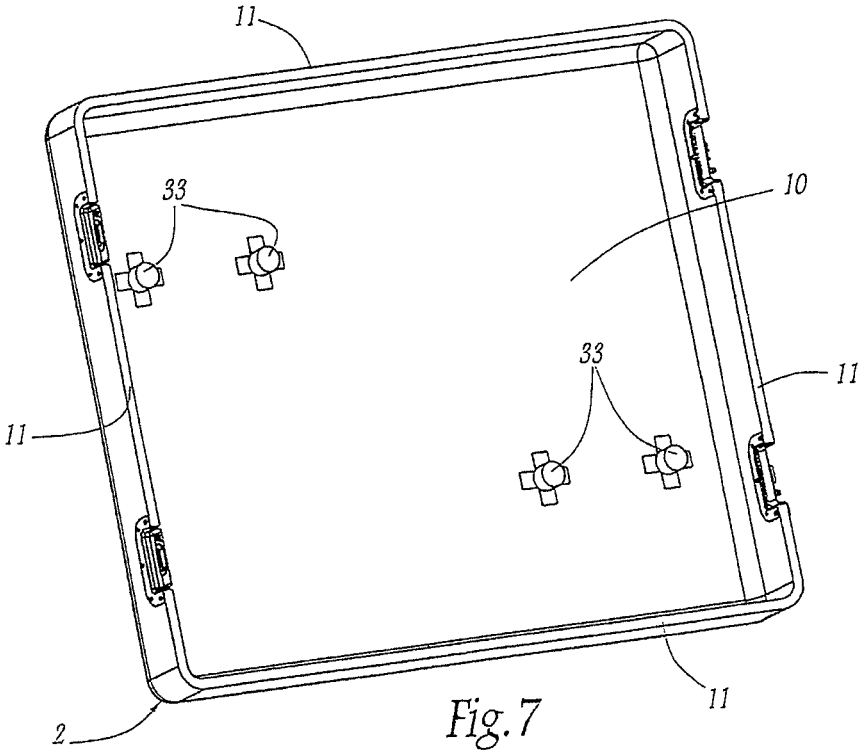
FIG. 7 is a schematic perspective view showing the interior of the trunk lid shown in FIG. 6.

The first trunk or bottom left-hand trunk M1 is a bottle trunk for transport of pressurized gas bottles 25 under suitable safety conditions. According to the example illustrated, the first trunk M1 is designed to take two gas bottles 25 and for this purpose comprises two partitions 26 and 27 parallel to one another and to the bottom 3 of the trunk. Each wall 26, 27 then incorporates two windows, one for each bottle 25. Each window 28 in a wall is then approximately aligned with a window 29 in another wall to define a housing to take a bottle. The windows 28 and 29 are then aligned on a central axis Δ inclined in relation to the bottom 3 of the trunk M1. The central axis Δ will then correspond to the longitudinal axis of the bottle when it is engaged in the corresponding windows 28 and 29. To ensure the correct position of each bottle 25, the windows are approximately elliptical in shape and are each equipped around their circumference with at least three rollers 30, only one of which per window is visible in FIG. 6. The rollers 30 are made of elastomer, for example, and are arranged at approximately 120° from one another at each window. The rollers 30 are designed to guide the corresponding bottle 25, when it is placed in position. To contribute to the correct position of the bottles during handling of the trunk M1, the body 1 of the trunk M1 contains at least one cushioning element 31 on the bottom such as an elastically deformable elastomer block, located approximately in the alignment of the axis Δ to form a support for the bottom of the corresponding gas bottle. For the same purpose, the lid 2 of the trunk M1 has on its internal face, as shown in FIG. 7, two elastically deformable cushioning elements 33, each cushioning element being designed to provide support for the head of the corresponding bottle 25 when the lid 2 closes the trunk M1. It can be seen that in the example shown, the lid comprises two sets of two cushioning elements 33 arranged symmetrically in relation to the centre of the lid top 10. This arrangement of the invention guarantees that one cushioning element will always be position in relation to a bottle whatever the mounting direction of the lid on the body of the trunk M1.

According to the example illustrated, the assembly L also comprises a drawer trunk M2, corresponding in FIG. 1 to the bottom right-hand trunk. In the example shown, the trunk M2 contains on its body 1 two internal partitions 35 which are perpendicular to two opposite sidewalls and to the bottom 3 of the body of the trunk M2, not visible. The partitions 35 are then integral with the sidewalls and the corresponding bottom. According to the example illustrated, the drawer trunk M2 also contains an internal dividing wall 36 which extends perpendicular to the internal partitions 35 and to the bottom of the drawer trunk M2. Therefore the internal partitions 35 and the dividing wall 36 define six compartments inside the trunk M2, each of which is designed to take a removable drawer 37 which is movable in translation.

To provide relaxation for the legs of a user who wishes to be seated while working on the equipment contained in the trunk M3 positioned above the trunk M2, the internal partitions 35 each have a U-shaped recess 38 with a depth of over 10 cm and a width of over 20 cm on either side of the dividing wall 36. Each U-shaped recess is arranged to allow a part of the corresponding internal partition 35 to remain on its edges to form a support slide for the corresponding drawer 37. To prevent any inconvenient movement of a drawer during transport of the trunk, each of them is fitted with a locking system 39 which allows the corresponding drawer 37 to be immobilized in a retracted position, as shown in FIG. 1.

The third trunk M3 forming the assembly L, as shown in FIG. 1, comprises a controlled atmosphere working hood.

The fourth and last trunk M4 forms a power supply trunk containing a power control and subtransmission unit 40, for example in the form of an inverter and a system comprising overvoltage protection devices.

To provide the power supply to the power supply trunk M4 and distribution of the power to the trunk M3, the trunk M4 contains on one of its sidewalls power connection and distribution means in the form of outlets 41. The trunk M3 also contains an outlet 41 to enable a patch cable, not shown, to be connected between the electricity distribution trunk M4 and the user trunk M3. It should be noted that the outlets 41 are located on the top faces of the trunks M3, M4 between their interlocking ribs, in order to provide a foolproofing function to prevent a trunk being stacked on trunks M3 and M4.

The laboratory L may be assembled from trunks M1 to M4 as follows.

Firstly, the bottom trunks M1 and M2 are placed side by side for engagement of their corresponding ribs. Then the trunk M4 is placed above the trunk M1, so as again to produce engagement of the corresponding ribs of the sidewalls in contact. The assembly is completed by placing the trunk M3 on top of the trunk M2. In view of the configuration of the interlocking ribs, it is possible to place the trunk M3 so that it is partially supported on the trunk M2, as shown in FIG. 7, and then to carry out translation of the trunk M3 in the direction of the arrow F1 until it lies flat against the trunk M4. The interlocking ribs then very advantageously define a slide which furthers this operation and reduces the risk of the trunk M3 falling when in translation. It should be noted that the sidewalls and particularly their flanges are designed not to obstruct said translation.

Figure 9:
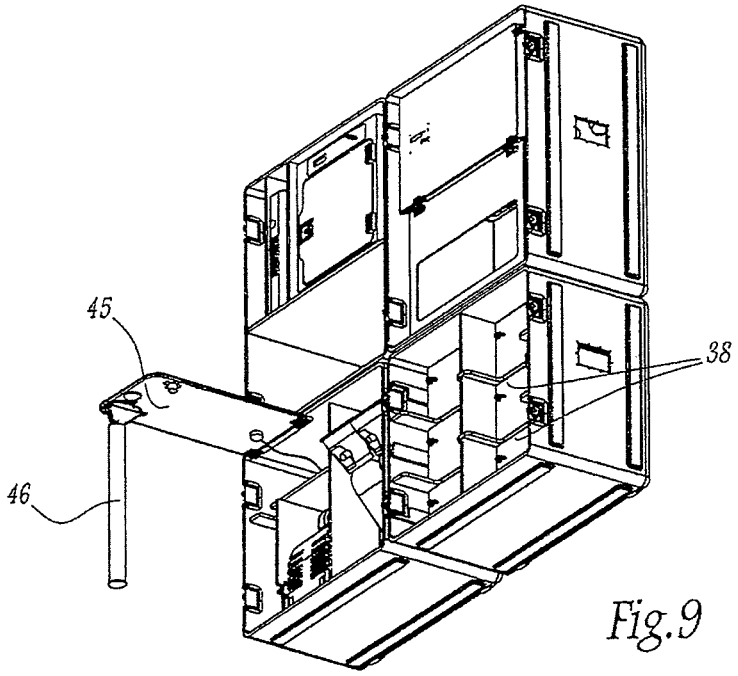
FIG. 9 is a schematic perspective view from below of the set of four trunks shown in FIG. 1 with a shelf folded out.
Figure 8:
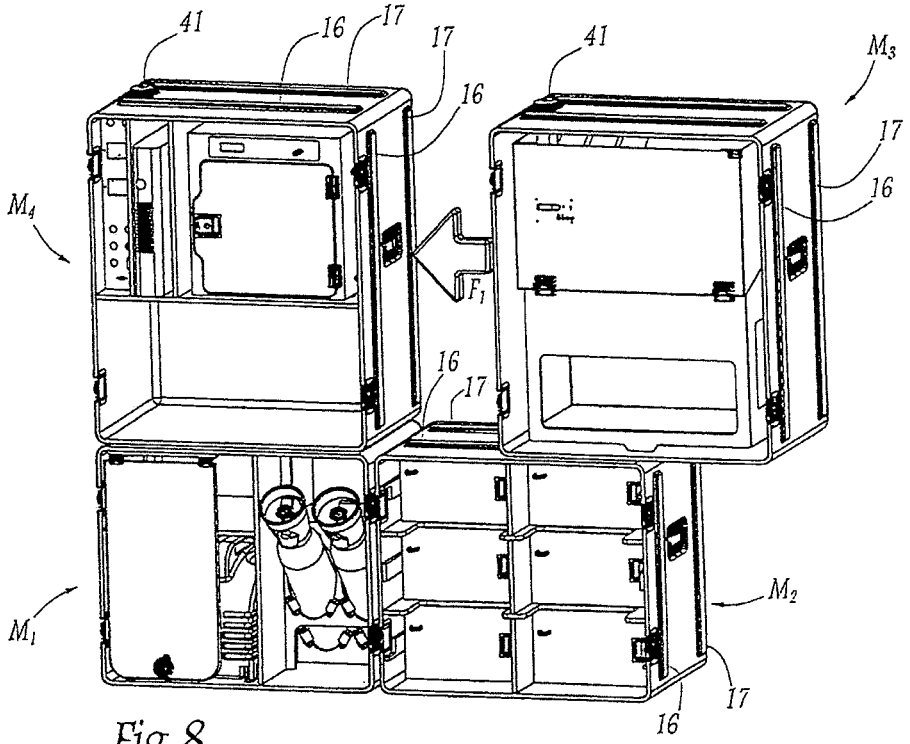
FIG. 8 is a schematic perspective view showing an assembly stage of the set of four trunks shown in FIG. 1.

In order to provide complementary work surfaces to users of the laboratory resulting from stacking trunks M1 to M4, the trunk M1 also comprises a shelf 45 which is movable between a folded position as illustrated in FIG. 1, in which it is approximately parallel to the bottom of the corresponding trunk, and an unfolded position as shown in FIG. 9, in which it is approximately perpendicular to the bottom to form a horizontal work surface. For this purpose the shelf 45 is equipped on its internal face with a folding foot 46. The shelf 45 also holds an outlet 49 to allow connection of an electrical or electronic device such as a PC. The outlet 49 is supplied by an external outlet 41 to be connected to an external outlet 41 on the trunk M4 by a cable, not shown. It should be noted that the outlet 41 is located between the ribs 16 and 17 of the sidewall on which it is situated so as to provide a foolproofing function by preventing said sidewall from being incorrectly coupled to the sidewall of another trunk. Thus the external outlets 41 on trunks M1, M4, M3 ensure that the four trunks in the set can only be assembled in the configuration illustrated in FIGS. 1, 8 and 9 because the fronts are always oriented on the same face of the set with a correct vertical orientation.

Figure 10:
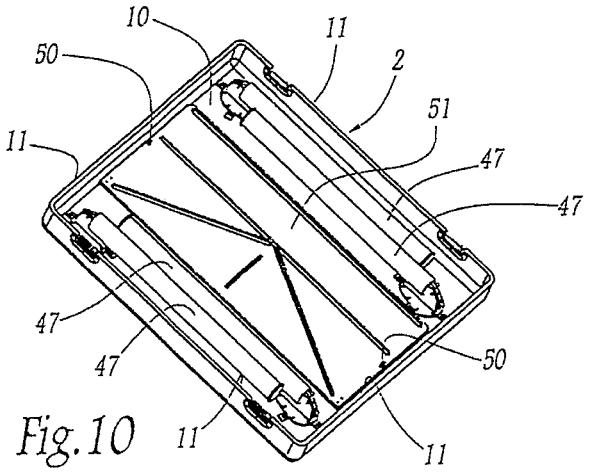
FIG. 10 is a schematic perspective view showing the interior of a trunk lid containing folding feet and a removable shelf.
Figure 11:
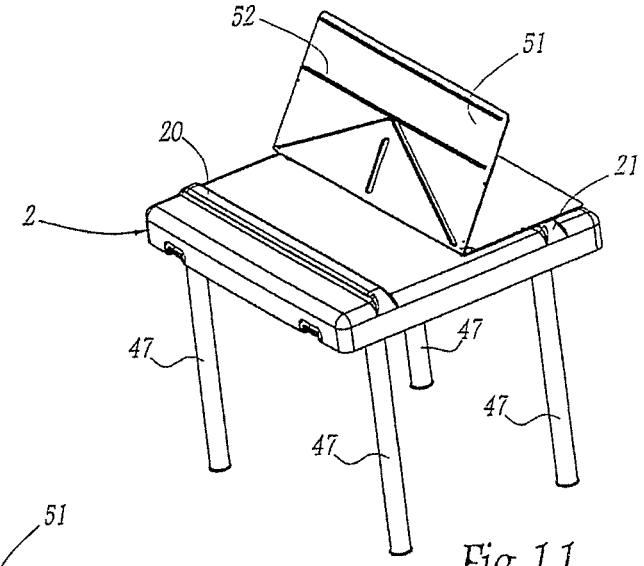
FIGS. 11 and 12 are perspective views of the lid shown in FIG. 9 with the feet folded out.
Figure 12:
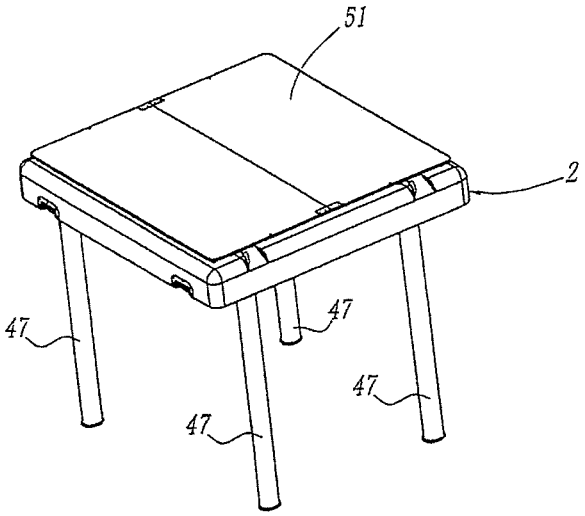

Again in order to provide additional work surfaces, the lids of the trunks may also contain folding feet 47, as shown in FIG. 10. Said feet 47 are fixed to the internal face of the top 10 of each corresponding lid and are designed to support said lid when they are positioned in the folded out position in which they extend vertically upwards, as shown in FIGS. 12 and 13.

In that position the lid can act as a work surface and for that purpose the lid contains, on the internal face of its top, support means 50 for a removable shelf 51 designed to be placed on the upper face of the lid, as shown in FIGS. 9 and 10. According to the example illustrated, it is flexible to enable it to be placed in the lid in the folded position between the feet 47. The removable shelf 51 is thus provided on its internal face with nesting means 52 designed to engage with the interlocking ribs 20, 21 of the lid to block the movement of the shelf, at least in a direction perpendicular to the ribs 20, 21. Further, the removable shelf 51 forms a clean surface suitable for fine work and/or work requiring good cleanliness conditions, in contrast to the outer surface of the lid 2 which will have been soiled during transport of the trunk and is therefore unsuitable for this type of work. It should be noted that without the shelf 51 the lid can also act as a support for the body of the corresponding trunk.

Various other modifications may of course be made to the invention within the scope of the attached claims.

The invention claimed is:

1. Assembly of at least two stackable transport trunks, each trunk having a body with a generally parallelepiped shape, comprising a bottom and four sidewalls connected to the bottom and being closed by a removable lid, wherein each trunk comprises nesting means on its four sidewalls comprising at least two mutually parallel interlocking ribs on each sidewall, the nesting means of one said trunk engaging with the nesting means of a sidewall of another said trunk on which it is stacked, wherein the nesting means of respective said trunks are adapted, when they engage, to define a sliding link having a sliding direction parallel to the sidewalls having the nesting means and to the bottoms of the trunks and for guiding the translation of the trunks on each other, the corresponding sidewalls being adapted for enabling the engagement of the nesting means and enabling said translation, wherein the opposite internal edges of the at least two mutually parallel interlocking ribs on each sidewall are separated by an internal gap, whilst the external edges facing towards the outside opposite the internal edges are separated by an external gap, wherein for each pair of opposite sidewalls of a respective said trunk, the external gap in the interlocking ribs on one of the opposite sidewalls is less than or equal to the internal gap in the interlocking ribs on the other of the opposite sidewalls, wherein respective adjacent sidewalls of a respective said trunk each have approximately equal internal and external gaps.

2. Assembly according to claim 1, wherein the interlocking ribs have a generally trapezoidal or rectangular form in transverse section.

3. Assembly according to claim 1, comprising a drawer trunk, the body of which contains at least one internal partition which is perpendicular to two opposite sidewalls and to the bottom and which defines at least one receiving compartment for a drawer, each partition having on its free edge situated opposite the bottom at least one U-shaped recess with a depth of over 10 cm, a width of over 20 cm and a length less than that of the internal partition measured parallel to the bottom, each drawer comprising a back and opposite to the back a front which is set back from or level with a longitudinal edge of the recess when the back of the drawer is in contact with the bottom of the drawer trunk.

4. Assembly according to claim 3, wherein each drawer contains means of locking the drawer in a retracted position, the back of the drawer being in contact with the bottom of the trunk.

5. Assembly according to claim 1, comprising a trunk for gas bottles, the body of which comprises at least two partitions parallel to each other and to the bottom, each of which is provided with a window, the windows in both partitions being aligned on a central axis inclined in relation to the bottom of the trunk to define a housing to take at least one cylindrical gas bottle under pressure when in position.

6. Assembly according to claim 5, wherein each window is elliptical in shape and is equipped on its circumference with at least three rollers designed to guide the bottle when it is placed in position.

7. Assembly according to claim 1, comprising a trunk which comprises a shelf hinged on a sidewall of the body of the trunk so as to be movable in rotation between a folded position in which it is parallel to the bottom of the trunk and an unfolded position in which it is parallel to the sidewall which holds it.

8. Assembly according to claim 1, comprising a trunk, the lid of which comprises folding feet on a bottom face which are designed to support the lid when they are in the folded out position.

9. Assembly according to claim 8, wherein the lid comprises nesting means on a top face which are designed to engage with the nesting means on a side face of said trunk.

10. Assembly according to claim 8, wherein the lid comprises means on its bottom face for holding a removable shelf designed to be placed on the top face of the lid, the shelf containing immobilization means on its bottom face which are designed to engage with the nesting means on the top face of the lid so as to block any translation of the shelf parallel to the top face of the lid.

11. Assembly according to claim 1, wherein it comprises at least one trunk containing electrical and/or electronic equipment and means of connection to an electromagnetic power source.

12. Assembly according to claim 11, further comprising:

a power supply trunk which contains an electricity control and subtransmission unit and electricity distribution means connection to the subtransmission unit; and a trunk containing electrical and/or electronic equipment and means of connection to the distribution means of the power supply trunk.

13. Assembly of at least two stackable transport trunks, each trunk having a body with a generally parallelepiped shape, comprising a bottom and four sidewalls connected to the bottom and being closed by a removable lid, one of the sidewalls of each trunk comprising nesting means for engaging with the nesting means of a sidewall of another trunk on which it is stacked, wherein the nesting means are adapted when they engage for defining a sliding link having a sliding direction parallel to the side faces having the nesting means and to the bottoms of the trunks and for guiding the translation of the trunks on each other, the corresponding sidewalls being adapted for enabling the engagement of the nesting means and enabling said translation, wherein one of said at least two stackable transport trunks is a drawer trunk, the body of which contains at least one internal partition which is perpendicular to two opposite sidewalls and to the bottom and which defines at least one receiving compartment for a drawer, each partition having on its free edge situated opposite the bottom at least one U-shaped recess with a depth of over 10 cm, a width of over 20 cm and a length less than that of the internal partition measured parallel to the bottom, each drawer comprising a back and opposite to the back a front which is set back from or level with a longitudinal edge of the recess when the back of the drawer is in contact with the bottom of the drawer trunk.

14. Assembly according to claim 13, wherein each drawer contains means for locking the drawer in a retracted position, the back of the drawer being in contact with the bottom of the trunk.

15. Assembly of at least two stackable transport trunks, each trunk having a body with a generally parallelepiped shape, comprising a bottom and four sidewalls connected to the bottom and being closed by a removable lid, one of the sidewalls of each trunk comprising nesting means for engaging with the nesting means of a sidewall of another trunk on which it is stacked, wherein the nesting means are adapted when they engage for defining a sliding link having a sliding direction parallel to the side faces having the nesting means and to the bottoms of the trunks and for guiding the translation of the trunks on each other, the corresponding sidewalls being adapted for enabling the engagement of the nesting means and enabling said translation, wherein one of said at least two stackable transport trunks is a trunk for gas bottles, the body of which comprises at least two partitions parallel to each other and to the bottom, each of which is provided with a window, the windows in both partitions being aligned on a central axis inclined in relation to the bottom of the trunk to define a housing to take at least one cylindrical gas bottle under pressure when in position.

16. Assembly according to claim 15, wherein each window is elliptical in shape and is equipped on its circumference with at least three rollers designed to guide the bottle when the bottle is placed in position.

17. Assembly of at least two stackable transport trunks, each trunk having a body with a generally parallelepiped shape, comprising a bottom and four sidewalls connected to the bottom and being closed by a removable lid, one of the sidewalls of each trunk comprising nesting means for engaging with the nesting means of a sidewall of another trunk on which it is stacked, wherein the nesting means are adapted when they engage for defining a sliding link having a sliding direction parallel to the side faces having the nesting means and to the bottoms of the trunks and for guiding the translation of the trunks on each other, the corresponding sidewalls being adapted for enabling the engagement of the nesting means and enabling said translation, wherein one said transport trunk has a lid comprising: folding feet on a bottom face which are designed to support the lid when they are in the folded out position, and means on its bottom face for holding a removable shelf designed to be placed on the top face of the lid, the shelf containing immobilization means on its bottom face which are designed to engage with the nesting means on the top face of the lid so as to block any translation of the shelf parallel to the top face of the lid.

18. Assembly according to claim 17, the lid further comprises nesting means on a top face which are designed to engage with the nesting means on a side face of said trunk.

* * * * *